US009339091B2

(12) United States Patent
Kaupp

(10) Patent No.: US 9,339,091 B2
(45) Date of Patent: May 17, 2016

(54) JEWELRY ARTICLE WITH REPLACEABLE ORNAMENTS

(71) Applicant: J.K. Jewelry, Inc., Rochester, NY (US)

(72) Inventor: John Kaupp, Rochester, NY (US)

( * ) Notice: Subject to any disclaimer, the term of this patent is extended or adjusted under 35 U.S.C. 154(b) by 48 days.

(21) Appl. No.: 14/505,991

(22) Filed: Oct. 3, 2014

(65) Prior Publication Data

US 2015/0020543 A1 Jan. 22, 2015

Related U.S. Application Data

(63) Continuation-in-part of application No. 14/068,698, filed on Oct. 31, 2013, now Pat. No. 8,869,555, which is a continuation of application No. 12/584,714, filed on Nov. 23, 2009, now Pat. No. 8,573,003.

(51) Int. Cl.

| | |
|---|---|
| ***A44C 25/00*** | (2006.01) |
| ***A44C 5/00*** | (2006.01) |
| ***A44C 7/00*** | (2006.01) |
| ***A44C 15/00*** | (2006.01) |
| ***A44C 13/00*** | (2006.01) |

(52) U.S. Cl.

CPC ..... *A44C 25/007* (2013.01); *A44C 5/00* (2013.01); *A44C 13/00* (2013.01); *A44C 15/005* (2013.01); *A44C 7/002* (2013.01); *A44D 2203/00* (2013.01); *Y10S 63/90* (2013.01)

(58) Field of Classification Search

CPC ..... A44C 15/005; A44C 25/007; A44C 5/00; A44C 7/002; A44C 13/00; Y10S 63/90; A44D 2203/00; Y10T 24/3904; Y10T 24/45188

See application file for complete search history.

(56) References Cited

U.S. PATENT DOCUMENTS 885,267 A * 4/1908 Martel ..... A44C 5/2042 24/587.11
1,410,770 A * 3/1922 Silverman ..... A44C 5/208 24/116 A
3,852,982 A * 12/1974 Faris ..... A44B 15/00 70/457
4,393,552 A * 7/1983 Frankel ..... A44C 5/20 24/627
4,562,704 A * 1/1986 Benedek ..... A44C 5/2047 24/616
6,357,261 B1 * 3/2002 Cheng ..... A44C 5/208 24/574.1
6,557,376 B2 * 5/2003 Pratt ..... A44C 11/002 63/23
6,901,771 B2 * 6/2005 Ooide ..... A44C 5/185 63/26
7,007,507 B2 * 3/2006 Enevoldsen ..... A44C 5/0053 63/3
7,540,172 B2 * 6/2009 Julkowski ..... A44C 5/0053 63/3
7,726,152 B2 * 6/2010 Beard ..... A44C 5/2076 24/303
7,802,448 B2 * 9/2010 Chan ..... A44C 5/2076 24/303
2005/0241335 A1 * 11/2005 Scharr ..... A44C 5/185 63/3.1
2005/0241336 A1 * 11/2005 Scharr ..... A44C 5/185 63/3.1
2009/0013720 A1 * 1/2009 Altick ..... A44C 5/185 63/3.1
2010/0030265 A1 * 2/2010 Ambrite ..... A44C 5/0007 606/236
2013/0305782 A1 * 11/2013 Butler ..... A44C 5/20 63/12

* cited by examiner

*Primary Examiner* — Robert J Sandy

*Assistant Examiner* — Louis Mercado

(74) *Attorney, Agent, or Firm* — Feldman Law Group, P.C.; Stephen E. Feldman

(57) ABSTRACT

A jewelry article having an elongated strand with a first section and a second section, a small-hole bead assembly, and a small-hole bead. The small-hole bead assembly includes a first mount, a second mount and a connecting bar. The small-hole bead assembly being positioned on the elongated strand between the first section and the second section with the small-hole bead being positioned on the connecting bar between the first mount and the second mount of the small-hole bead assembly.

19 Claims, 15 Drawing Sheets

JEWELRY ARTICLE WITH REPLACEABLE ORNAMENTS

CROSS-REFERENCE TO RELATED APPLICATION

This application is a continuation-in-part of application Ser. No. 14/068,698, filed Oct. 31, 2013, now U.S. Pat. No. 8,869,555, which is a continuation of application Ser. No. 12/584,714, filed Nov. 23, 2009, now U.S. Pat. No. 8,573,003. The patent applications identified above are incorporated here by reference in their entirety to provide continuity of disclosure.

BACKGROUND

The disclosed technology relates to jewelry articles, and more particularly to an article that includes interchangeable ornaments for the personal customization.

The conventional jewelry systems typically add and/or remove beads by having to individually screw and unscrew each individual bead for stringing the beads along a strand, and utilize threaded keepers, threaded bands and hinged keepers to lock beads in place. However, these systems are tedious to use. For example, U.S. Pat. No. 7,007,507 discloses necklaces and bracelets with keepers. The keepers are removably attached to bands fixed at intervals on the strands of the necklaces or bracelets. These keepers have internal threads to interact with threaded bands. U.S. Pat. No. 7,007,507 B2 also uses hinged keepers to lock the beads in place in addition to beads which must be threaded over a cylindrical loop on the end of the strand. The threading process requires the use of threaded components or ornaments that are very expensive besides being tedious to use. The threaded system used in these conventional jewelry systems can also be difficult to use for children or people with physical limitations.

The prior art safety catches and/or clasps prevent easy and inadvertent disengagement or detachment of clasping ends and minimize the risk of potential loss of the jewelry. However, fastening of such articles behind the hand/neck require both hands to be used by a user/wearer. In such a situation, said clasps/catches are substantially difficult to open or close. The prior art magnetic clasps with safety catches are external attachments and may hurt the wearer. In addition, exterior orientation of the clasp simply renders them unattractive for some users.

There is a need for a jewelry article that allows for beads and other elements to be taken off and/or on by simply sliding them along the strand without individually having to unscrew each individual bead or string beads along a strand. There is also a need for a jewelry article wherein the beads can be positioned, removed and locked in place in a non-tedious manner by utilizing a threading mechanism that is non-expensive. There is a need for a jewelry article that includes an inbuilt magnetic clasping means adapted to facilitate an easy gripping, opening or closing arrangement for the article.

SUMMARY OF THE INVENTION

A jewelry article comprising: an elongated strand, the elongated strand having at least a first section and a second section, the first section having a clasp end and a first assembly end, and the second section having a clasp-receiving end and a second assembly end; at least one small-hole bead assembly, the small-hole bead assembly includes a first mount, a second mount and a connecting bar, the first mount having a strand side and a connecting bar side, the strand side of the first mount being affixed to the first assembly end of the first section of the elongated strand, and the connecting bar side of the first mount being removably affixed to the connecting bar, the second mount having a strand side and a connecting bar side, the strand side of the second mount being affixed to the second assembly end of the second section, and the connecting bar side of the second mount being removably affixed to the connecting bar; and a small-hole bead, e.g., a pearl, semi-precious stone, precious metal or base metal bead the small-hole bead having a through hole, the through hole receiving the connecting bar, and the small-hole bead being positioned between the first mount and the second mount.

In some implementations, the connecting bar can have two male threaded ends for connecting to female threads of the first mount and second mount. The small-hole bead can have a diameter which is approximately equal to a length of the connecting bar minus a length of the two male threaded ends. The connecting bar diameter is in a range of 0.005 to 3 mm. The diameter of the through hole for the small-hole bead may be slightly larger than the diameter of the connecting bar.

In some implementations, the jewelry article can include a first plug located on the first assembly end, the first plug having an outermost diameter that is equal to or smaller than an outer diameter of the elongated strand, the first plug having male threads, wherein the strand side of the first mount has female threads on an interior surface thereof and is sized for mating with the male threads of the first plug.

In some implementations, the jewelry article can include a second plug located on the second assembly end, the second plug having an outermost diameter that is equal to or smaller than the outer diameter of the elongated strand, the second plug having male threads, wherein the strand side of the second mount has female threads on an interior surface thereof and is sized for mating with the male threads of the second plug.

In some implementations, the jewelry article can include a third plug located on a proximal end of the elongated strand, the third plug having an outermost diameter that is equal to or smaller than an outer diameter of the elongated strand, the third plug having male threads; and a proximal ring cap, the proximal ring cap having female threads on an interior surface thereof and is sized for mating with the male threads of the third plug.

In some implementations, the jewelry article can include a fourth plug located on a distal end of the elongated strand, the fourth plug having an outermost diameter that is equal to or smaller than the outer diameter of the elongated strand, the fourth plug having male threads; and a distal ring cap, the distal ring cap having female threads on an interior surface thereof and is sized for mating with the male threads of the fourth plug.

In some implementations, the jewelry article can include a second small-hole bead assembly wherein the elongated strand includes a third section having two assembly ends for accommodating the first and second small-hole bead assembly on the article.

In some implementations, the jewelry article can include at least one bead, the at least one bead having a through hole; and a flexible resilient tube, the flexible resilient tube being positioned within the through hole of the at least one bead, wherein the at least one bead is slidably positioned on the elongated strand with the flexible tube engaging the elongated strand so as to fixedly position and prevent movement of the at least one bead on the elongated strand. In some implementations, the jewelry article can include at least one ornament.

In some implementations, the jewelry article can be a bracelet, a necklace, an anklet, an earring or a belt.

The advantage of the disclosed technology is that small-hole beads can be strung onto the disclose strand by boring a small diameter hole in the bead and inserting a connecting bar into the hole. The connecting bar with the bead can then be removably attached to the strand as the strand can be further decorated with different types of removable beads based on a preference of the wearer.

DETAILED DESCRIPTION

Figure 1:
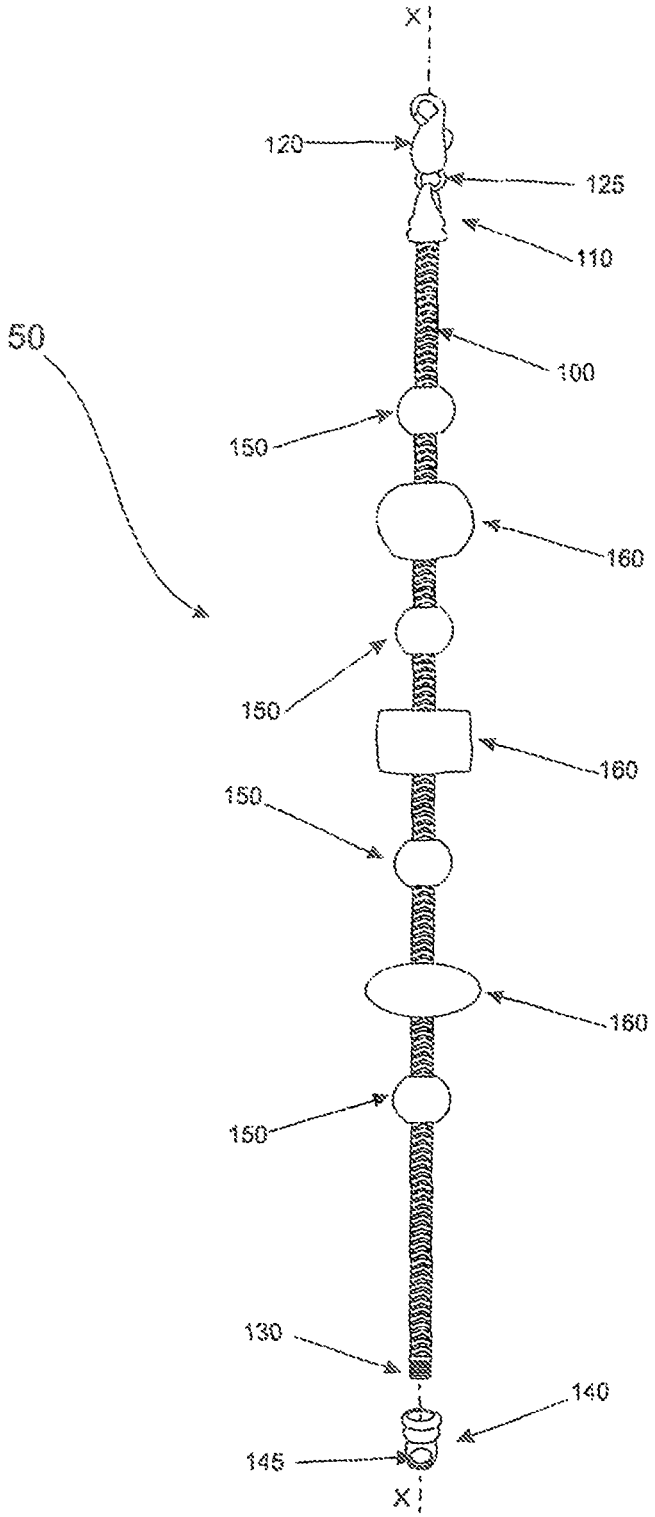
FIG. 1 is an exploded front view of a preferred embodiment of a jewelry article constructed in accordance with the present invention in an open position.
Figure 2:
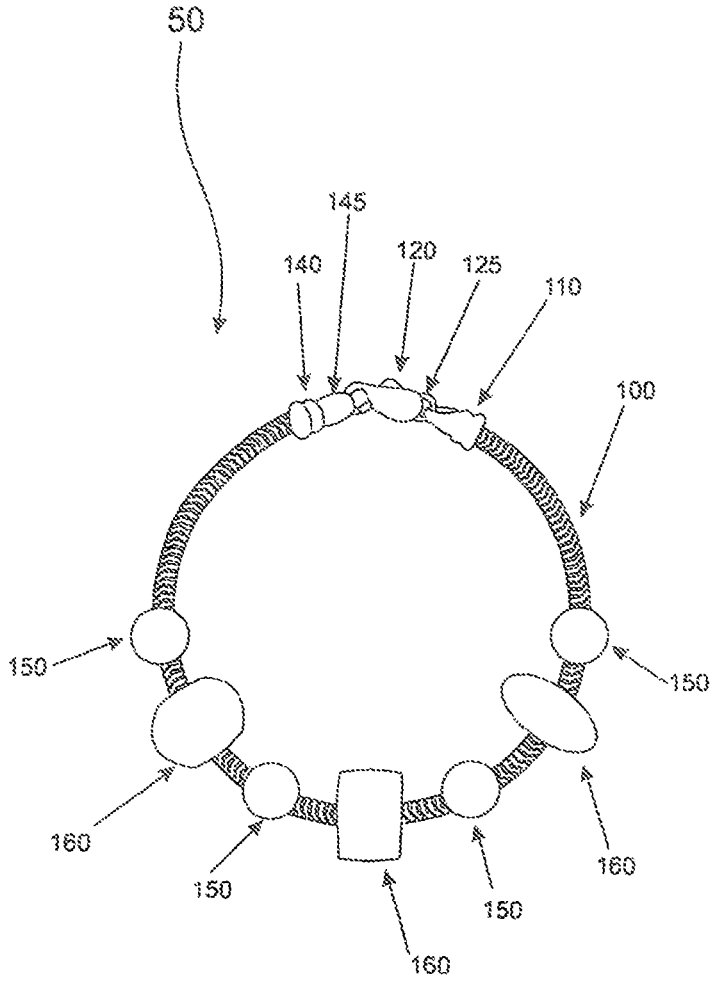
FIG. 2 is a front view of the jewelry article of FIG. 1 in a closed position.

Referring to FIGS. 1-2, an article of jewelry 50 includes an elongated support or strand 100. The elongated support or strand 100 may be made of, but not limited to, any suitable strong, flexible material such as rubber, satin, plastic or silk, or rigid material such as a chain made of silver, gold or steel. Strand 100 is concentrically positioned along a central vertical axis-X. Strand 100 has a proximal end that is permanently affixed to a first ring cap 110. The first ring cap 110 is connected to a clasp 120 through a connecting ring 125. Strand 100 has a distal end that includes a plug 130 that is permanently attached to strand 100. Plug 130 has a plurality of male threads adapted to receive a second ring cap 140 that has a plurality of female threads. The female threaded second ring cap 140 is adapted to be screwed and/or unscrewed on to male threaded plug 130. The cap 140 defines a loop 145 that connects to clasp 120 to define a closed position of article 50. Article 50 has an open position wherein the clasp 120 is adapted to be disconnected from loop 145. In this one preferred embodiment, article 50 is manually operable between the open and closed positions by a user.

The first ring cap 110 is permanently affixed to strand 100 by soldering this finding onto chain or strand 100. However, it is understood known joining techniques other than soldering can also be employed in other alternative embodiments. Clasp 120 in this one preferred embodiment is a lobster claw clasp. However, it is understood that the other clasps such as a spring ring clasp, a trigger or push lock clasp, a box clasp, and a toggle clasp may be used in other alternative embodiments of article 50.

Figure 3:
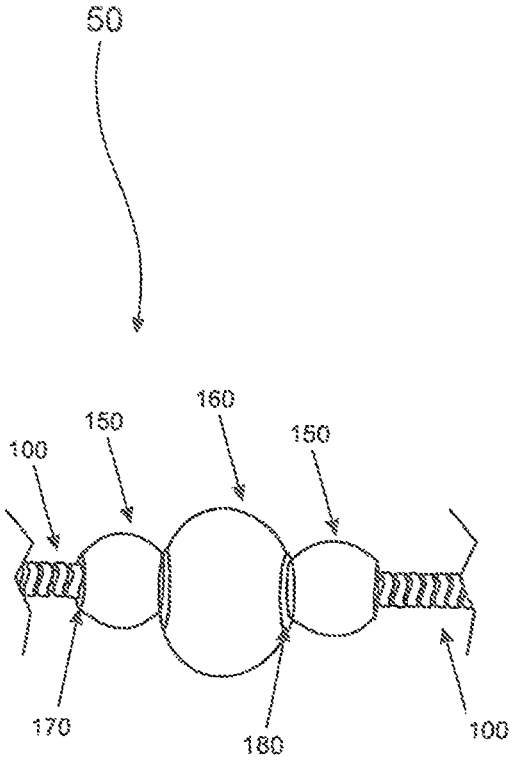
FIG. 3 is a partially enlarged perspective view of a bead portion of the article of FIG. 1.

As shown in FIGS. 2-3, article 50 includes a plurality of customizable smart beads 150 and a plurality of customizable ornaments/decorative beads 160. In this one preferred embodiment, each decorative bead 160 is adapted to be positioned within two smart beads 150. However, it is understood that arrangement of beads 150, 160 may substantially vary per intended application of article 50. It is also understood here that the article 50 may not include smart beads 150 in other alternative embodiments of article 50.

Referring again to FIG. 3, each of the beads 160 has a through hole 170 that has a diameter that is relatively larger than the diameter of the strand 100 to allow bead 160 to comfortably slide off/on the strand 100. Each of the smart beads 150 has a through hole 180 that has a diameter that is relatively larger than the diameter of the strand 100 to allow beads 150 to comfortably slide off/on the strand 100. It is understood that many types of adornments for beads 160 can be used such as beads, baubles, bangles or Murano glass beads. It is also understood that the decorative beads 160 can be made of various materials such as silver, crystal, pearl or hand painted glass.

Figure 4:
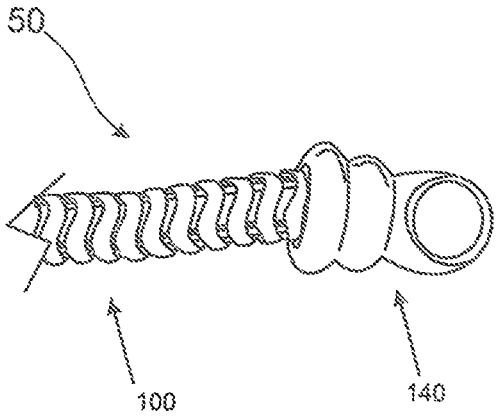
FIG. 4 is a partially enlarged perspective view of a second cap portion of the article of FIG. 1.
Figure 5:
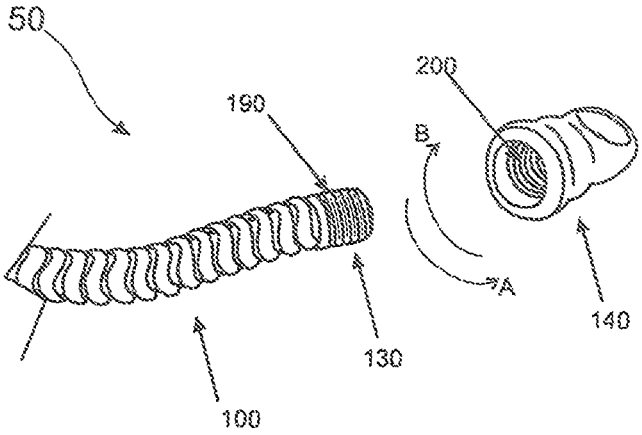
FIG. 5 is a partially enlarged and exploded perspective view of the second cap portion of the article of FIG. 1.

As shown in FIGS. 4 and 5, second ring cap 140 has an unlocked position and a locked position. Plug 130 has an outer surface that includes a plurality of male threads 190. The ring cap 140 has an inner surface that includes a plurality of female threads 200. The threads 190, 200 preferably engage and/or disengage with each other to respectively define locked and/or unlocked positions of cap 140. In this one preferred embodiment, cap 140 is preferably adapted to be rotated over plug 130 in a counterclockwise direction indicated by an arrow-A to disengage threads 190, 200 while unscrewing or removing cap 140 from strand 100. In this one preferred embodiment, cap 140 is preferably adapted to be rotated over plug 130 in a clockwise direction indicated by an arrow-B to engage threads 190, 200 while screwing or positioning cap 140 on strand 100.

Figure 6:
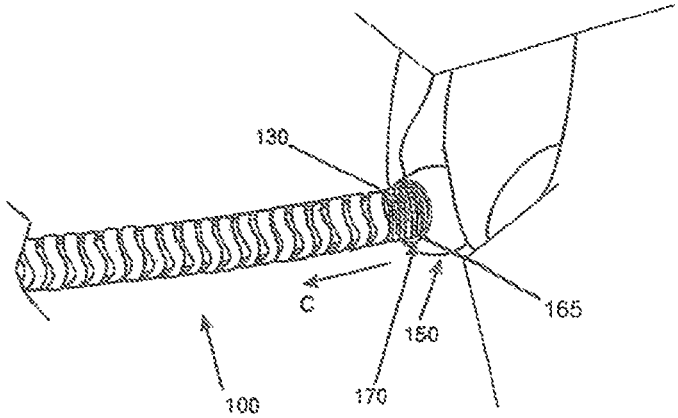
FIG. 6 is a partially enlarged perspective view of the article of FIG. 1 in use for insertion of a first smart bead.
Figure 7:
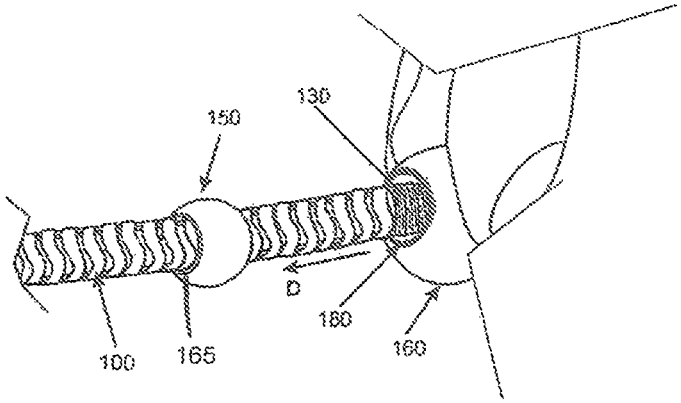
FIG. 7 is a partially enlarged perspective view of the article of FIG. 1 in use for insertion of a decorative bead.
Figure 8:
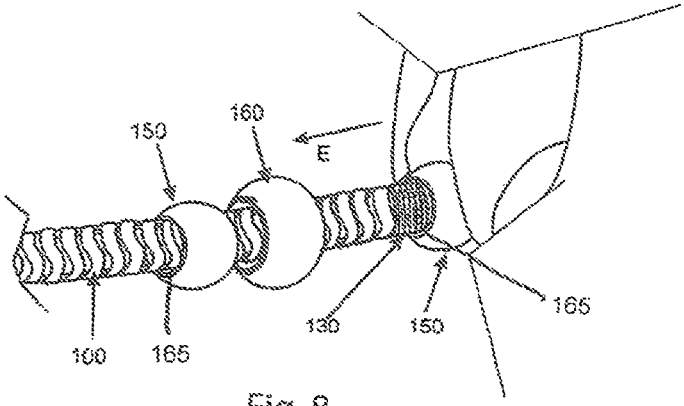
FIG. 8 is a partially enlarged perspective view of the article of FIG. 1 in use for insertion of a second smart bead.

Referring to FIGS. 6-8, beads 150, 160 are adapted to be slidably positioned on strand 100 in the unlocked position of the cap 140. In this preferred embodiment, the smart beads 150 preferably have diameters between 6-10 mm, and most preferably 8 mm. However, it is understood that other sizes of beads 150 may be utilized per intended application of article 50. The user initially slides/inserts a first smart bead 150 through plug 130 in a linear direction indicated by an arrow-C as shown in FIG. 6. The user further slides the decorative bead 160 onto strand 100 in a linear direction indicated by an arrow-D as shown in FIG. 7. The user further slides a second smart bead 150 onto strand 100 in a linear direction indicated by an arrow-E as shown in FIG. 8.

Smart beads 150 are preferably adapted to restrain or prevent movement of the decorative beads 160 in this one preferred embodiment. The smart bead 150 is a self-stopping smart bead that is well known in the art. One such smart bead is outlined in U.S. Pat. No. 6,557,376. Each of the beads 150 has a flexible resilient tube 165 that is positioned inside a shell of bead 150 in alignment with the holes of bead 150. The tube has a length that is either equal to or smaller than the spacing of the holes of bead 150. The tube 165 engages with strand 100 to fix the position of the bead 160 on strand 100 and prevents the movement or slide of beads 160. It is understood here that the number of decorative beads 160 and smart beads 150 may substantially depend on intended application of article 50.

Figure 9:
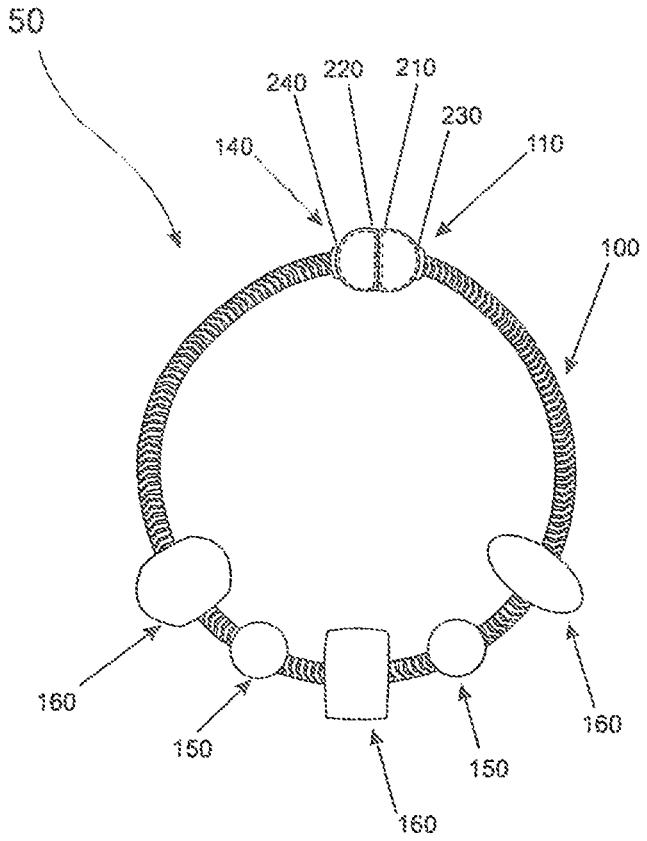
FIG. 9 is an alternative embodiment of the jewelry article of FIG. 1.

Referring to FIG. 9, an alternative embodiment of article 50 is shown. In this one alternative embodiment, first ring clasp 110 and second ring clasp 140 has front end portions 210, 220 respectively. In this one alternative embodiment, a first clasp 110 and a second clasp 140 also has rear end portions 230, 240 respectively. Front end portions 210, 220 are magnetically attachable to define the closed position of article 50. Rear end portions 230, 240 are removably connectable to/from strand or chain 100.

Figure 10:
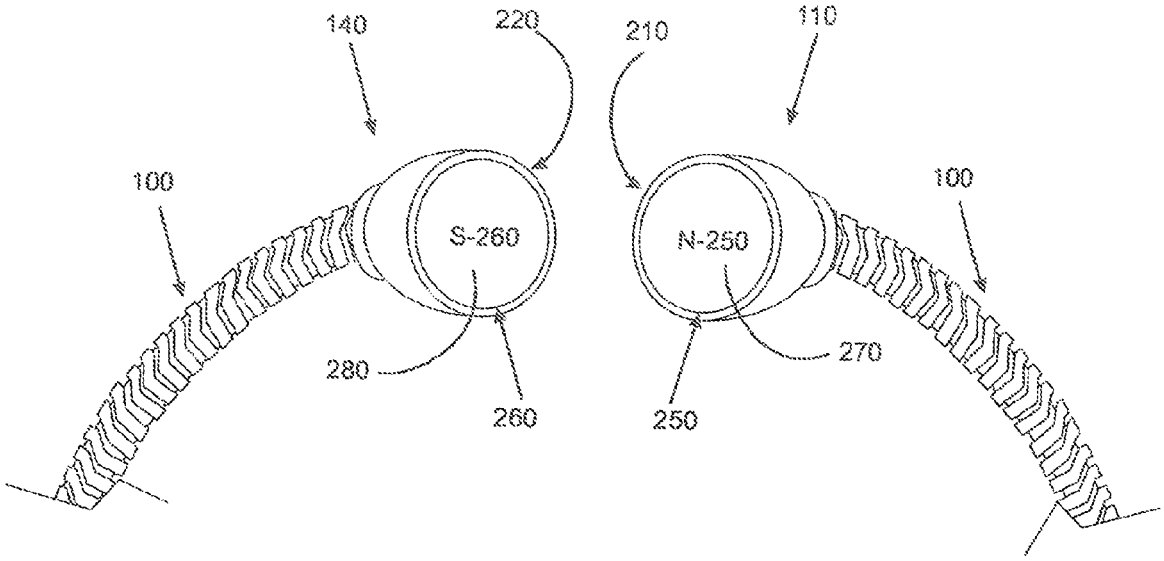
FIG. 10 is a partially enlarged front perspective view of the first and second clasp portions of the jewelry article of FIG. 9.

As shown in FIG. 10, front end portion 210 of clasp 110 defines a cavity that includes a first magnet 250. Front end portion 220 of clasp 140 defines a cavity that includes a second magnet 260. Magnets 250, 260 are preferably adhesively secured into front end portions 210, 220. However, it is understood that magnets 250, 260 may be secured within front end portions 210, 220 using alternative techniques such as crimping and soldering. Magnets 250, 260, in this one preferred embodiment, are preferably made of permanent magnetic material such as Sintered Neodymium Iron Boron (NdFeB) N50. However, it is understood that Magnets 250, 260 may be made of permanent magnetic materials such as, for example, Samarium cobalt, Alnico Ceramic, and Ferrite. The Magnet 250 has a North Pole N-250 that is flushed or aligned with front end portion 210 to define a first magnetically attractive surface 270. Magnet 260 has a south pole S-260 that is flushed or aligned with front end portion 220 to define a second magnetically attractive surface 280. Magnetic clasps 110, 140 are adapted to be substantially aligned along a common axis such that South Pole S-260 of magnet 260 comfortably aligns or engages with North Pole N-250 of magnet 250 such that first magnetically attractive surface 270 magnetically attaches to second magnetically attractive surface 280 to define a locking arrangement of article 50.

Figure 11:
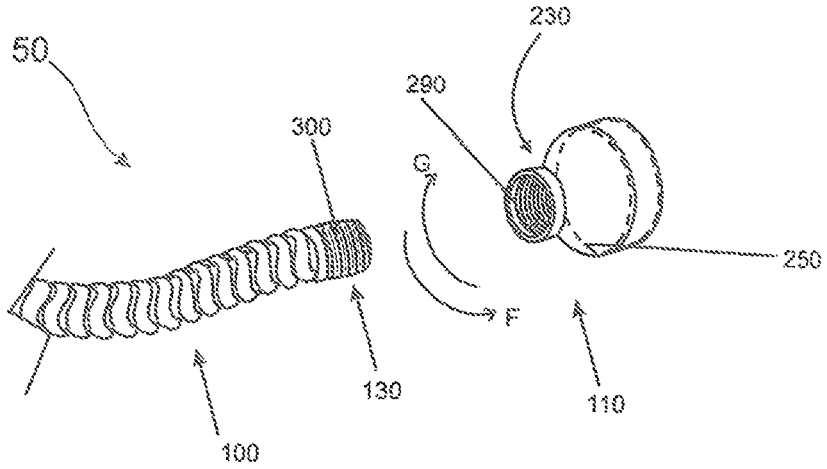
FIG. 11 is a partially enlarged and exploded rear perspective view of the first clasp portion of the jewelry article of FIG. 9.

Referring to FIG. 11, rear end portion 230 of a first clasp 110 in this alternative embodiment has a plurality of female threads 290 that are preferably adapted to be rotatably engaged or disengaged with a plurality of male threads 300 of plug 130 to respectively define a locked or an unlocked position of clasp 110. Clasp 110 is preferably adapted to be rotated over plug 130 in a counterclockwise direction indicated by an arrow-F to disengage threads 290, 300 while unscrewing or removing clasp 110 from strand 100. Clasp 110 is preferably adapted to be rotated over plug 130 in a clockwise direction indicated by an arrow-G to engage threads 290, 300 while screwing or positioning clasp 110 on to strand 100. However, it is understood here that clasp 110 may be permanently attached to strand 100 in other alternative embodiments of article 50.

Figure 12:
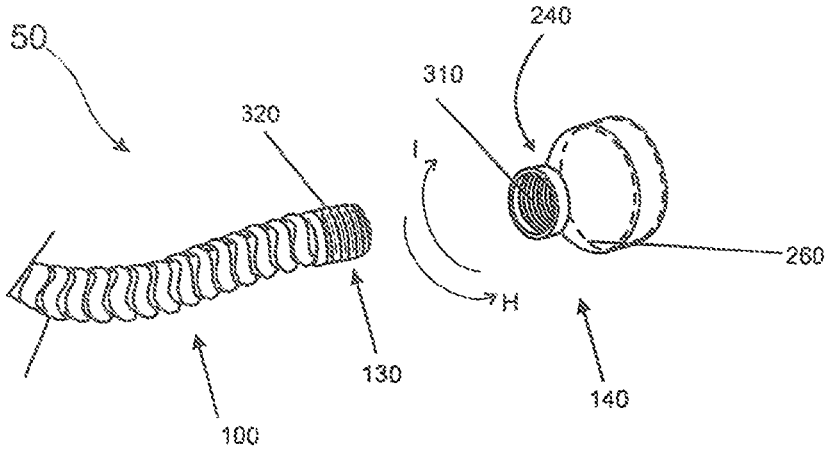
FIG. 12 is a partially enlarged and exploded rear perspective view of the second clasp portion of the jewelry article of FIG. 9.

Referring to FIG. 12, rear end portion 240 of clasp 140 in this alternative embodiment has a plurality of female threads 310 that are preferably adapted to be rotatably engaged or disengaged with a plurality of male threads 320 of plug 130 to define a locked or an unlocked position of clasp 140. Clasp 140 is preferably adapted to be rotated over plug 130 in a counterclockwise direction indicated by an arrow-H to disengage threads 310, 320 while unscrewing or removing clasp 140 from strand 100. Clasp 140 is preferably adapted to be rotated over plug 130 in clockwise direction indicated by an arrow-I to engage threads 310, 320 while screwing or positioning clasp 140 on to strand 100. However, it is understood here that clasp 140 may be permanently attached to strand 100 in other alternative embodiments of article 50.

Referring to FIGS. 1-12, in operation, the article 50 can be a necklace, bracelet, anklet, belt or other elongated support that advantageously allows for the personal customization by the easy removal or addition of beads, baubles or bangles or other ornaments. The ring clasps 110, 140 include magnets 250, 260 that advantageously facilitate an inbuilt clasping means for the ornament 50 and eliminate the need of using clasp 120. The smart beads 150 advantageously prevent the movement of beads 160 that are strung on the elongated support 100. The use of male-female arrangement in accordance with removable second ring clasp 140 advantageously allows ornament 50 to be effortlessly modified/redecorated and significantly reduces the time required for replacement of beads 150,160. Therefore, jewelry articles in accordance with the present invention are readily and quickly customizable per the whims and fancies of the user.

Referring to FIGS. 13-18, an article of jewelry 400 includes an elongated support or strand 402. The elongated support or strand 402 can be made of, but not limited to, any suitable material such as metals, precious metals, rubbers, satins, plastics, silks, or any other rigid material for making a jewelry chain, e.g., necklaces, bracelets, belts, anklets, earrings, etc. For example, the jewelry chain can be made from silver, gold or platinum. The elongated support or strand 402 can have an approximate outer diameter of 1-10 mm.

Figure 15:
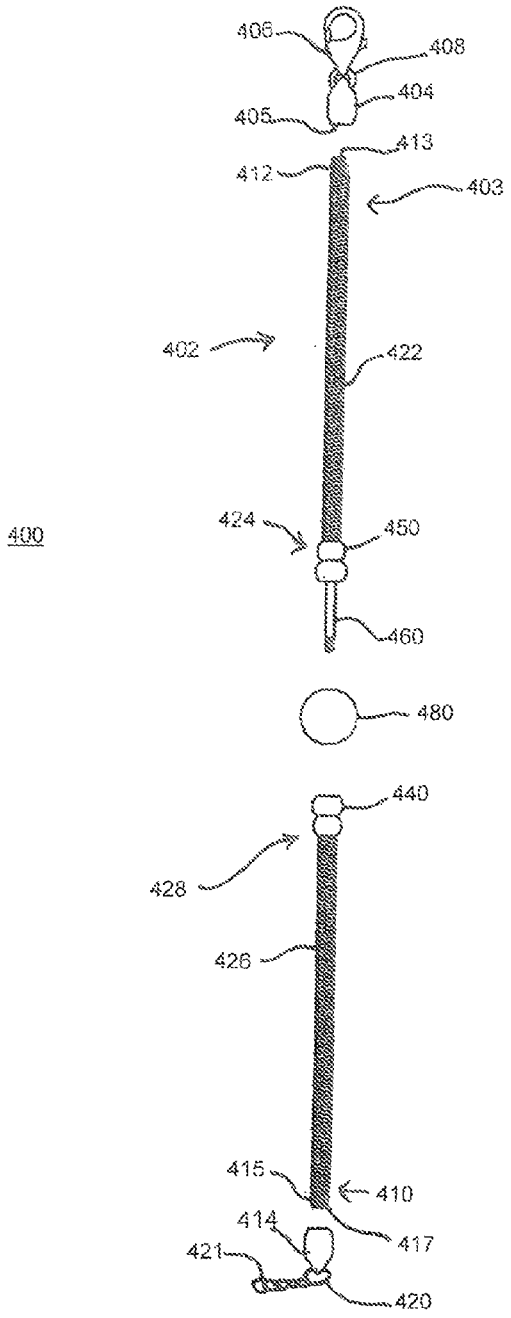
FIG. 15 is a top view of a jewelry article in an open and unassembled position having a small-hole bead assembly as disclosed in the specification.

As shown in FIG. 15, strand 402 has a proximal end 403 that can be affixed to a ring cap 404. The ring cap 404 can be connected to a clasp 406 through a connecting ring 408. The ring cap 404 can be permanently affixed to strand 402 by, e.g., soldering or be removably affixed to strand 402 by, e.g., threading, as described below. It is also understood that other joining techniques, other than soldering or threading, can be employed in other implementations. e.g., a bayonet connection.

In one implementation, the proximal end 403 of strand 402 can include a plug 412 that can be permanently attached to strand 402, e.g. by soldering or use of an epoxy. The outmost diameter of the plug 412 is equal to or smaller than the diameter of the strand 402. Plug 412 can have a plurality of male threads 413 adapted to receive and be connected with a plurality of female threads located within an opening on the ring cap 404. That is, the ring cap 404 is adapted to be screwed and unscrewed onto the male threaded plug 412. The ring cap 404 can also be attached to it a loop 408 on the other end of the ring cap 404. This loop 408 (also called a jump ring) can also be connected to the ring cap 404 and to a clasp 406.

Strand 402 has a distal end 410 that can be affixed to a second ring cap 414. The second ring cap 414 can also be permanently affixed to strand 402 by, e.g., soldering or be removably affixed to strand 402 by, e.g., threading. In one implementation, the distal end 410 of strand 402 can include a plug 415 that can be permanently attached to strand 402. Plug 415 can have a plurality of male threads 417 adapted to receive and be connected with a plurality of female threads located within an opening on the ring cap 414. That is, the ring cap 414 is adapted to be screwed and unscrewed onto the male threaded plug 415. The ring cap 414 can also be attached to a loop or jump ring 420 that can connect the ring cap 414 to a chain 421.

Figure 13:
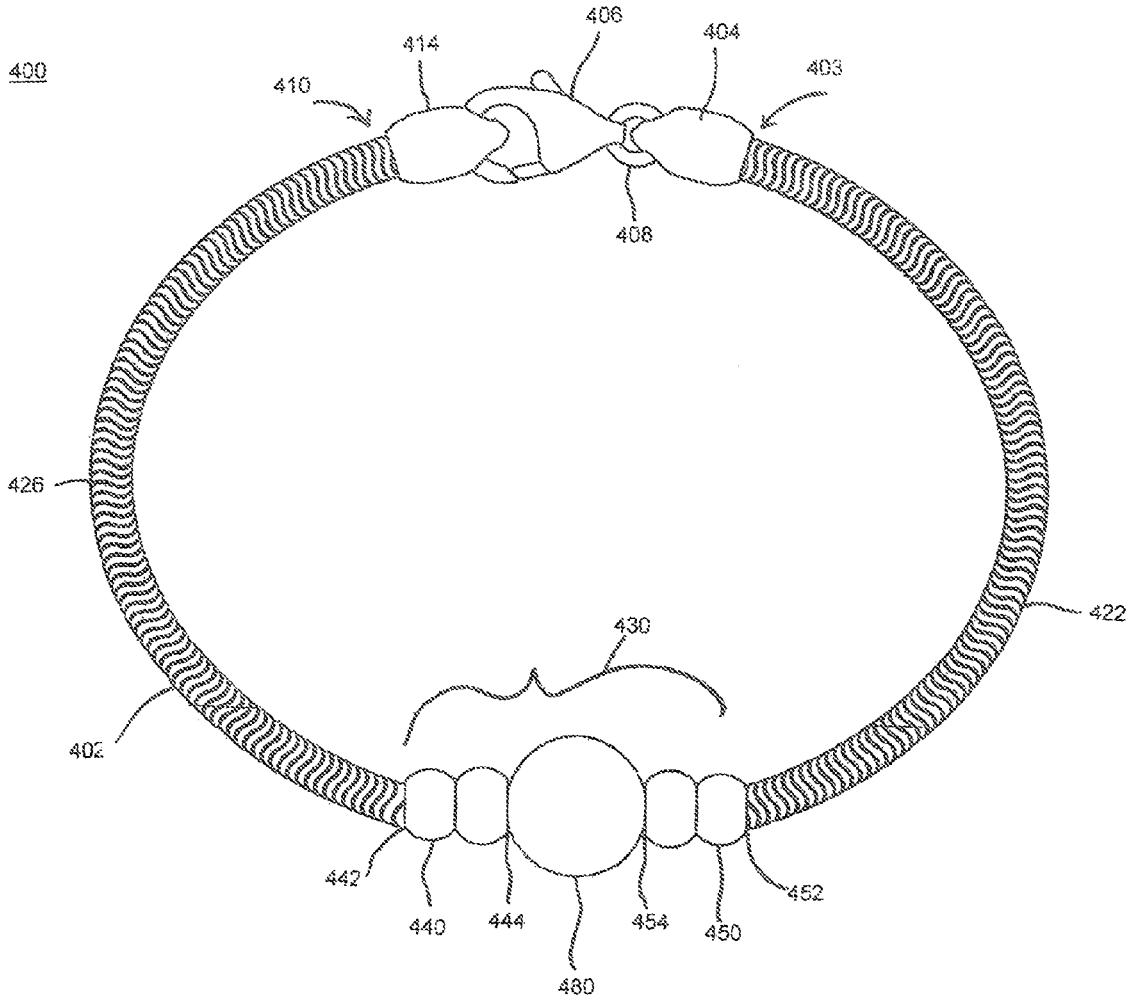
FIG. 13 is a top view of a jewelry article in a closed position having a small-hole bead assembly as disclosed in the specification.
Figure 14:
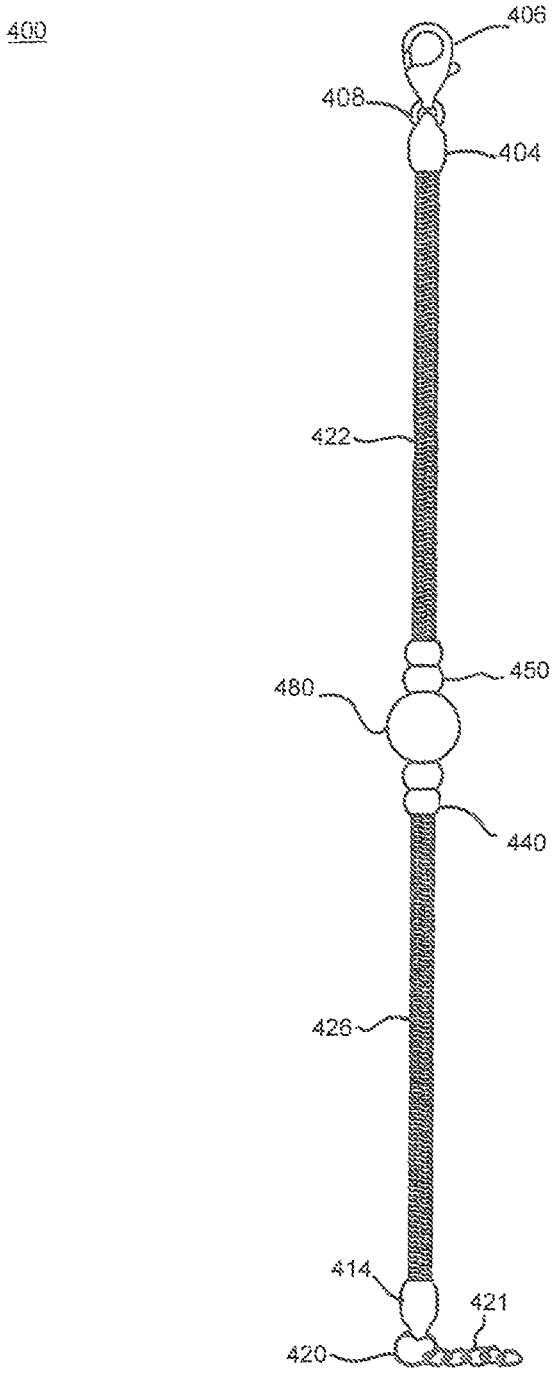
FIG. 14 is a top view of a jewelry article in an open position having a small-hole bead assembly as disclosed in the specification.

The clasp 406 and the ring cap 414, loop 420 or chain 421 define a closed position of the jewelry article 400, as shown in FIG. 13. Jewelry article 400 also has an open position, as shown in FIG. 14, wherein the clasp 406 is adapted to be disconnected from second ring cap 414, loop 420 or chain 421. Jewelry article 400 is manually operable between the open and closed positions by a user. The clasp 406 can be a lobster claw clasp, however, it is also understood that the other clasps such as a spring ring clasp, a trigger clasp, a push lock clasp, a box clasp, bayonet clasp and a toggle clasp may be used in other alternative implementations of the jewelry article 400.

As shown in FIGS. 1-3 and 6-9 described above, a plurality of customizable smart beads 160 and a plurality of customizable ornaments/decorative beads 150 can be positioned on the strand 402. The smart beads 160 can be self-stopping beads. That is, each of the smart beads 160 can have a flexible resilient tube 165 positioned inside a shell of the smart bead 160 in alignment with the through hole of the smart bead 160. The tube 165 has a length that is either equal to or smaller than the spacing of the through holes of the smart bead 160. The tube 130 engages with the strand 402 to fix the position of the smart bead 160 on strand 402 and prevents the movement or slide of the smart bead 160. The smart bead 160 also can be adapted to restrain or prevent movement of the decorative beads 150 positioned on the strand 402. It is understood that the number of decorative beads 150 and smart beads 160 may substantially depend on intended application of article 400.

Figure 15A:
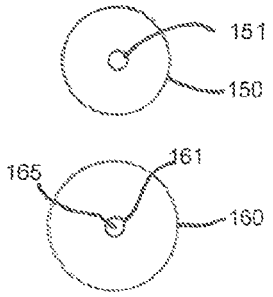
FIG. 15*a* shows side views of smart beads and ornamental beads used with the disclosed technology.
Figure 16:
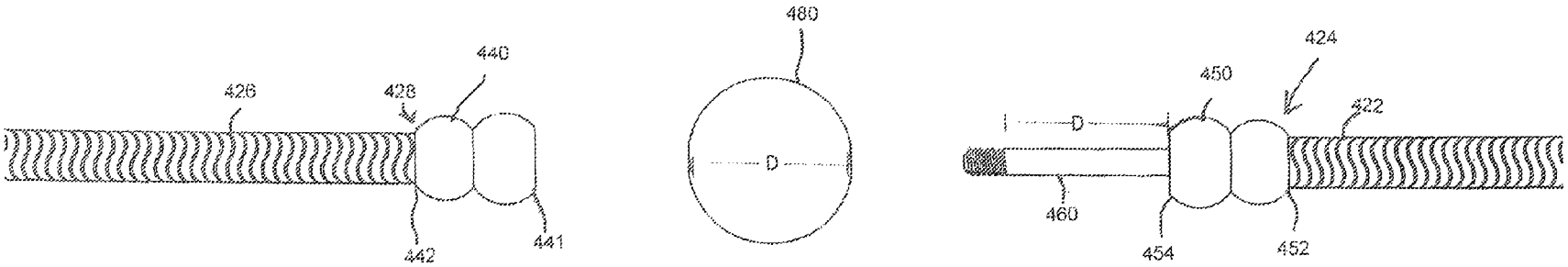
FIG. 16 is an exploded view of the small-hole bead assembly of the jewelry article as disclosed in the specification.
Figure 17:
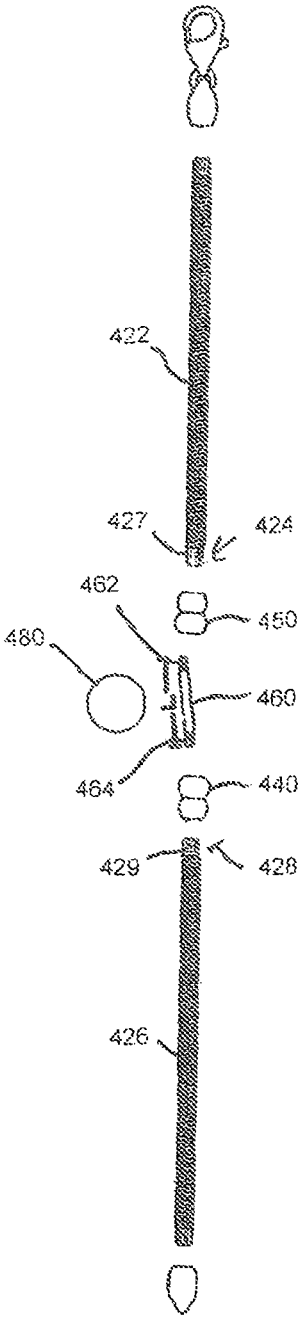
FIG. 17 is a top view of a jewelry article in an open and unassembled position having a small-hole bead assembly as disclosed in the specification.
Figure 17A:
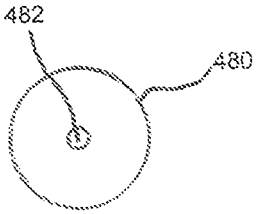
FIG. 17*a* shows a side view of a pearl used with the disclosed technology.
Figure 18:
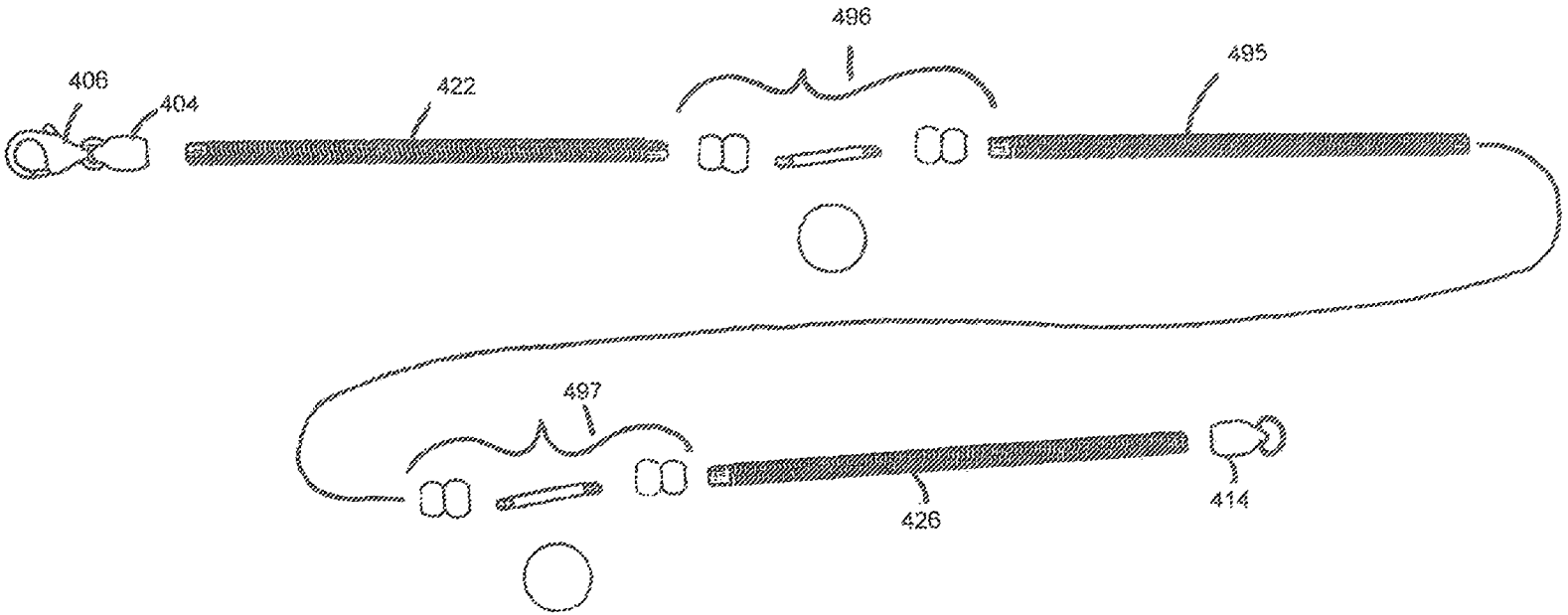
FIG. 18 is a top view of a jewelry article in an open and unassembled position having two pearl assemblies as disclosed in the specification.

As shown in FIG. 15*a*, these smart beads 150 and decorative beads 160 have through holes 161, 151, respectively that have diameters that are slightly larger than the diameter of the strand 402. For example, beads 150, 160 can have through-hole diameters between 4-10 mm. These through holes 151, 161 allow the beads 150, 160 to slide on and off the strand 402. The smart beads 160 can include beads, such as, plastic beads, baubles, bangles or Murano glass beads. The decorative beads 150 can be made of various materials such as silver, crystal, hand painted glass or any other material for manufacturing beads.

A problem, however, arose when preparing small-hole beads, e.g. pearls, for stringing on the disclosed strand. That is, when boring a through hole slightly larger than the diameter of the strand 402 into a naturally-made bead, e.g., a pearl or other small hole bead, using conventional techniques, the integrity of the pearl was compromised and the pearl would fracture and break. A solution was needed that would allow pearls and other small hole stones and beads to be removably inserted onto and off of the strand 402.

Figure 19:
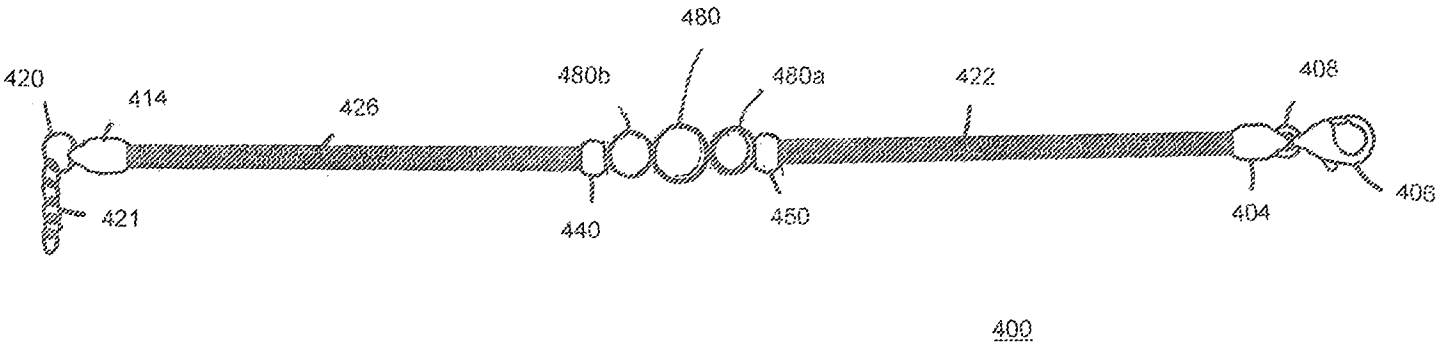
FIG. 19 shows a small bead assembly having multiple beads.

In order to overcome the problem, a small-hole bead assembly 430 is disclosed. As shown in FIGS. 13-17, jewelry article 400 includes a small-hole bead assembly 430. The small-hole bead assembly can include a first mount 450, a second mount 440 and a connecting bar 460. The first mount and the second mount can be any aesthetically pleasing design from metals to beads. To incorporate the small-hole bead assembly, the strand 402 may be split into multiple sections but for ease of explanation, the strand 402 can include a first section 422 having a first assembly point 424 and a second section 426 having a second assembly point 428. In these illustrations only one small-hole bead assembly is shown but multiple pearl assemblies are contemplated depending on the length of the strand, the preference of the user and the intended application of article 400 (e.g., see FIG. 19 that includes two pearl assembles 496, 497 and strand sections 422, 426 and 495, however, any number of pearl assemblies can be used).

The first mount 450 of the small-hole bead assembly 430 can include a strand side 452 and a connecting bar side 454. The strand side 452 of the first mount 450 can be affixed to the first assembly point 424 of the first section 422 by, e.g., permanently affixing the first mount 450 to strand 402 by soldering or removably affixing the first mount 450 to strand 402 by threading. For example, as shown on FIG. 17, the first assembly point 424 can include a plug 427 that can be permanently attached to the strand 402 at the first assembly point 424 similar to plugs 412, 415. Plug 427 can have a plurality of male threads adapted to be received with a plurality of female threads located within an opening of the first mount 450 on the strand side 452. That is, the first mount 450 is adapted to be screwed and/or unscrewed on to male threaded plug 427. It is also understood that other joining techniques, other than soldering or threading, can be employed in other implementations, e.g., a bayonet connection.

The connecting bar side 454 of the first mount 450 can also include a plurality of female threads located within an opening of the first mount 450. These female threads are used for mating with the connecting bar 460 as will be described more fully below.

The second mount 440 of the small-hole bead assembly 430 can also include a strand side 442 and a connecting bar side 444. The strand side 442 of the second mount 440 can be affixed to the second assembly point 428 of the second section 426 by, e.g., permanently affixing the second mount 440 to strand 402 by soldering or removably affixing the second mount 440 to strand 402 by threading. For example, the second assembly point 428 can include a plug 429 that can be permanently attached to the strand 402 at the second assembly point 428. Plug 429 can have a plurality of male threads adapted to receive with a plurality of female threads located within an opening of the second mount 450. In other words, the second mount 450 is adapted to be screwed and unscrewed onto the male threaded plug 429.

The connecting bar side 444 of the second mount 440 can include a plurality of female threads located within an opening of the second mount 440. These female threads are used for mating with the connecting bar 460, as will be described more fully below.

The connecting bar 460 is an elongated bar having a length and a diameter with male treads 462, 464 on either end of the length. The diameter of the connecting bar 460 was chosen because, after testing, it was discovered that if small-hole beads, e.g., pearls, were to be incorporated onto the disclosed strand that the small-hole beads need to have an approximate through hole diameter of less than 3 mm. After testing, it was also discovered that in order to keep the connecting bar rigid and functional that that connecting bar 460 should have an approximate diameter greater than 0.005 mm. Therefore, in order for a small-hole bead to be used with the disclosed small-hole bead assembly, the connecting bar diameter can have a range of 0.005 mm to 3 mm. The corresponding through hole for the small-hole beads 480 would be slightly larger than the diameter of the connecting bar 460. The length L of the connecting bar would be approximately equal to the diameter D of the pearl plus the lengths of the male plugs, 462, 464. In other implementations, the length can be longer than the diameter of the small-hole bead 480 so that one large small-hole bead 480 and several smaller small-hole beads 480*a*, 480*b* can be arranged on a single connecting bar. (See FIG. 19).

In use, a first end of the connected bar can be threadably connected to the first mount. The small-hole bead is slidably received by the connecting bar. A second end of the connecting bar is threadably connected to the second mount. In some implementations, one end of the connecting bar can be permanently affixed to the mount and only one end of the connecting may be threadably received into one of the mounts.

The foregoing description of the preferred embodiments of the present invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

Since many embodiments of the present disclosure can be made without departing from the spirit and scope of the present invention, the present invention resides in the claims hereafter appended. It is also to be understood that the following claims are intended to cover all of the generic and specific features of the invention described herein.

What is claimed:

1. A jewelry article comprising:

an elongated strand, the elongated strand having at least a first section and a second section, the first section having a clasp end and a first assembly end, and the second section having a clasp-receiving end and a second assembly end;

at least one small-hole bead assembly, the small-hole bead assembly includes a first mount, a second mount and a connecting bar, the first mount having a strand side and a connecting bar side, the strand side of the first mount being affixed to the first assembly end of the first section of the elongated strand, and the connecting bar side of the first mount being affixed to the connecting bar, the second mount having a strand side and a connecting bar side, the strand side of the second mount being affixed to the second assembly end of the second section, and the connecting bar side of the second mount being affixed to the connecting bar; and a small-hole bead, the small-hole bead having a through hole, the through hole receiving the connecting bar, and the small-hole bead being positioned between the first mount and the second mount.

2. The jewelry article as claimed in claim 1 wherein the small-hole bead is a pearl, semi-precious stone, precious metal or base metal bead.

3. The jewelry article as claimed in claim 2 wherein diameter of the through hole for the small-hole bead is slightly larger than diameter of the connecting bar.

4. The jewelry article as claimed in claim 1 wherein the connecting bar has two male threaded ends for connecting to female threads of the first mount and second mount.

5. The jewelry article of claim 4 further comprising:

at least one ornament.

6. The jewelry article as claimed in claim 1 wherein the small-hole bead has a length which is approximately equal to a length of the connecting bar minus a length of two male threaded ends.

7. The jewelry article as claimed in claim 6 further comprising:

a second plug located on the second assembly end, the second plug having an outermost diameter that is equal to or smaller than outer diameter of the elongated strand, the second plug having male threads, wherein the strand side of the second mount has female threads on an interior surface thereof and is sized for mating with the male threads of the second plug.

8. The jewelry article as claimed in claim 6 further comprising:

a third plug located on a proximal end of the elongated strand, the third plug having an outermost diameter that is equal to or smaller than an outer diameter of the elongated strand, the third plug having male threads; and a proximal ring cap, the proximal ring cap having female threads on an interior surface thereof and is sized for mating with the male threads of the third plug.

9. The jewelry article of claim 8 wherein the jewelry article is a bracelet.

10. The jewelry article of claim 8 wherein the jewelry article is a necklace.

11. The jewelry article of claim 8 wherein the jewelry article is an anklet.

12. The jewelry article of claim 8 wherein the jewelry article is an earring.

13. The jewelry article of claim 8 wherein the jewelry article is a belt.

14. The jewelry article as claimed in claim 1 wherein a length of the connecting bar minus a length of two male threaded ends accommodates two or more small-hole beads.

15. The jewelry article as claimed in claim 1 wherein the connecting bar diameter is in a range of 0.005 to 3 mm.

16. The jewelry article as claimed in claim 15 further comprising:

a fourth plug located on a distal end of the elongated strand, the fourth plug having an outermost diameter that is equal to or smaller than outer diameter of the elongated strand, the fourth plug having male threads; and a distal ring cap, the distal ring cap having female threads on an interior surface thereof and is sized for mating with the male threads of the fourth plug.

17. The jewelry article as claimed in claim 15 further comprising:

a second small-hole bead assembly wherein the elongated strand includes a third section having two assembly ends for accommodating the at least one small-hole bead assembly and the second small-hole bead assembly on the jewelry article.

18. The jewelry article as claimed in claim 1 further comprising:

a first plug located on the first assembly end, the first plug having an outermost diameter that is equal to or smaller than an outer diameter of the elongated strand, the first plug having male threads, wherein the strand side of the first mount has female threads on an interior surface thereof and is sized for mating with the male threads of the first plug.

19. The jewelry article of claim 1 further comprising:

at least one bead, the at least one bead having a through hole; and a flexible resilient tube, the flexible resilient tube being positioned within the through hole of the at least one bead, wherein the at least one bead is slidably positioned on the elongated strand with the flexible tube engaging the elongated strand so as to fixedly position and prevent movement of the at least one bead on the elongated strand.

* * * * *